United States Patent [19]

Wilson

[11] 4,355,954

[45] Oct. 26, 1982

[54] PUMP IMPELLER

[75] Inventor: James D. Wilson, Newton, Iowa

[73] Assignee: The Maytag Company, Newton, Iowa

[21] Appl. No.: 170,111

[22] Filed: Jul. 18, 1980

[51] Int. Cl.[3] ..... F04D 29/66; F04D 1/04

[52] U.S. Cl. ..... 415/213 B; 415/143; 416/183

[58] Field of Search ..... 416/183, 241 A, 186 R; 415/213 B, 143, 140, 119

[56] References Cited

U.S. PATENT DOCUMENTS

| | | | |
|---|---|---|---|
| 2,393,127 | 1/1946 | Summers | 103/104 |
| 2,902,941 | 9/1959 | Kiba | 416/241 A |
| 3,228,344 | 1/1966 | Cooper | 103/115 |
| 3,364,860 | 1/1968 | Schmitt-Matzen | 103/3 |
| 3,398,866 | 8/1968 | La Flame et al. | 137/394 |
| 3,481,531 | 12/1969 | MacArthur et al. | 416/183 |
| 3,782,851 | 1/1974 | Hackbarth et al. | 416/183 X |
| 3,953,146 | 4/1976 | Sowards | 416/183 X |
| 3,953,150 | 4/1976 | Onal | 416/184 |

FOREIGN PATENT DOCUMENTS

| | | | |
|---|---|---|---|
| 1277416 | 6/1972 | United Kingdom | 416/183 |
| 1293553 | 10/1972 | United Kingdom | 416/183 |
| 2053368 | 2/1981 | United Kingdom | 416/183 |
| 602694 | 4/1978 | U.S.S.R. | 416/183 |

*Primary Examiner*—Everette A. Powell, Jr.
*Attorney, Agent, or Firm*—Richard L. Ward

[57] ABSTRACT

A bidirectional pump is provided which includes a pair of impellers each operable for pumping liquid in one direction of operation. One of the impellers has modified vane structure for reducing turbulent liquid flow conditions when rotated in a reverse direction in a volute pump cavity. The modified vane structure reduces noise emission characteristics of the impeller when operated in a pump cavity substantially depleted of liquid.

13 Claims, 5 Drawing Figures

PUMP IMPELLER

BACKGROUND OF THE INVENTION

This invention relates generally to the field of liquid pumping apparatus and more particularly to a dishwashing apparatus having a bidirectional pump and a pump impeller which has improved noise emission characteristics.

In the appliance industry it is common practice in dishwasher design to provide a two-cavity pump operable in a first direction of rotation for recirculating washing liquid within the washing chamber and in a second direction for removing turbid washing liquid from the washing chamber sump. When the turbid washing liquid is removed from the washing chamber it is possible that objectionable noise may be emitted from the recirculation cavity of the pump as it is emptied. This noise is partially due to turbulence created by the action of the washing liquid in the pump cavity adjacent the outlet. Another possible source of noise during draining is from the generation of high frequency sound as the impeller blades pass the cut-off shoulder of the pump cavity volute.

One prior art solution to the generation of high frequency sound spaces the vanes of the impeller in a nonrepetitive angular fashion around the impeller base to produce a range of sound frequencies.

Still another prior art solution to the noise problem is the provision of a clutched recirculation impeller which will rotate only in one direction thus eliminating a source of noise as the washing chamber sump and the pump cavity are emptied of liquid in the drain portion of a cycle of operations.

None of the known pump arrangements provide for noise reduction through the use of different groups of vanes with one of the groups of vanes being effectively axially shorter than the other group of vanes.

SUMMARY OF THE INVENTION

It is therefore an object of the instant invention to provide an improved pump impeller.

It is a further object of the instant invention to provide a pump impeller having improved noise emission characteristics when operated in a reverse direction.

It is a still further object of the instant invention to reduce pump noise by reducing the turbulent liquid flow through the pump impeller when operated in a reverse direction.

Briefly, the instant invention achieves these objects in a centrifugal pump impeller including a base with a hub at the axis of rotation and further including a plurality of vanes fixed to the base and extending upwardly therefrom. First vanes are spaced about the rotational axis with leading edges at a first radius spaced from the axis and with bodies extending outwardly toward the outer periphery of the base. Second vanes are disposed between adjacent pairs of at least a portion of the first vanes with leading edges at a second radius spaced from the rotational axis and also extending outwardly and upwardly. The first and second vanes include vanes having at least a portion effectively reduced in axial height.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
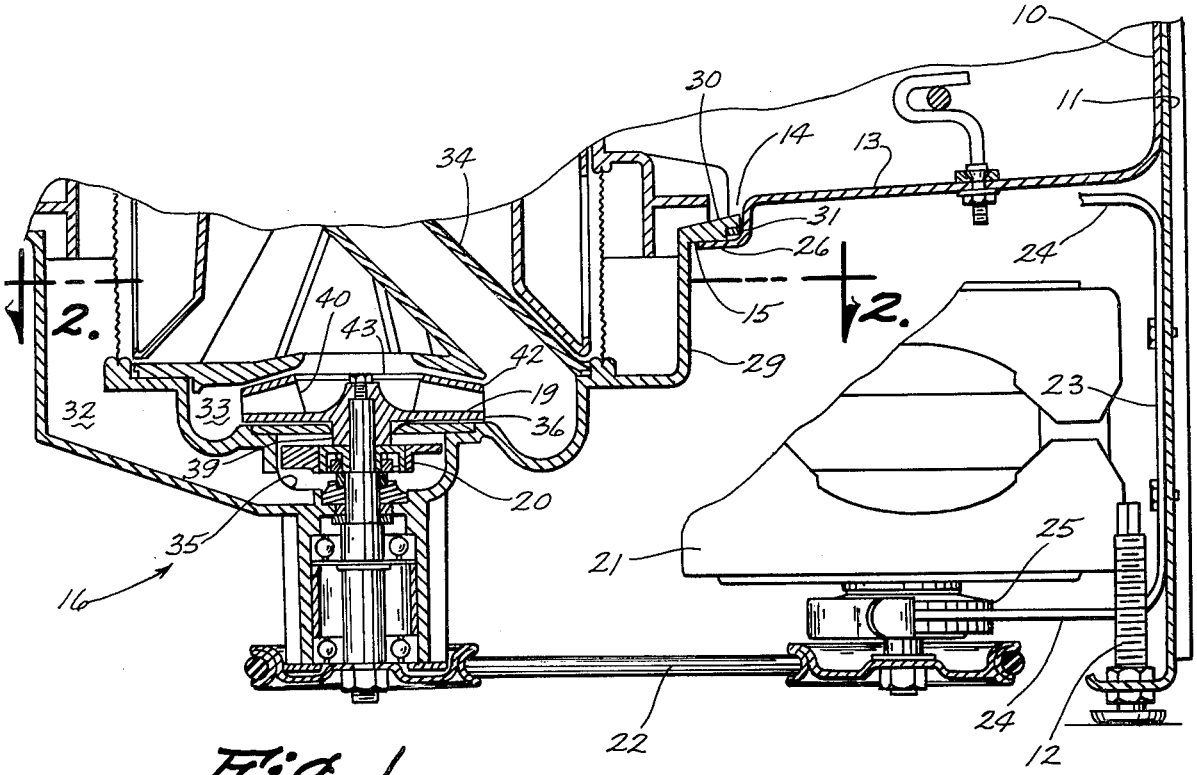
FIG. 1 is a partial section view as taken through the bottom wall of a dishwashing apparatus and showing a pump housing depending therefrom.

Referring now to the drawings there is shown in FIG. 1 a fragmentary lower portion of a dishwashing apparatus. The dishwasher includes a tub or liquid container 10 of which only a lower portion is shown and to which is attached a pair of side supports 11 which extend downwardly and receive a plurality of floor engaging members including screw-in foot members 12 for supporting and leveling the dishwashing apparatus.

The liquid container or tub 10 defines a chamber having a bottom wall 13 which includes a generally central recess 14 and opening 15 in which is positioned a combination sump and pump assembly 16 including a recirculating pump impeller 19 operable for effecting a recirculation of liquid to the washing chamber and a drain pump impeller 20 for removing washing liquid from the chamber.

Figure 2:
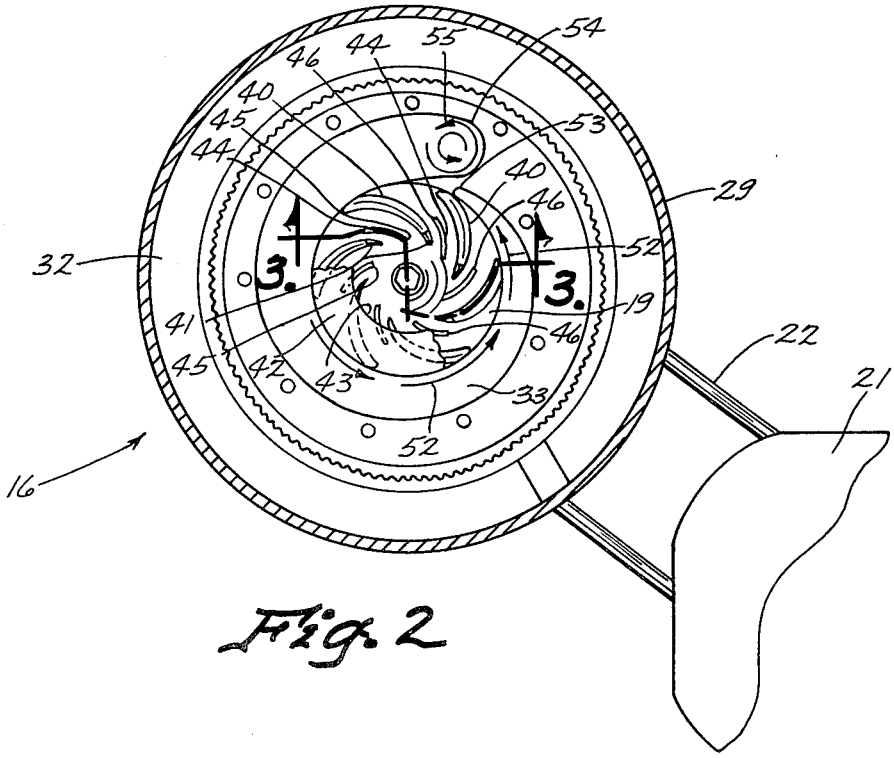
FIG. 2 is a sectional view taken generally along lines 2—2 of FIG. 1 and showing the recirculation pump cavity and impeller.

As shown in FIGS. 1 and 2, the recirculation and drain pump impellers 19 and 20 are connected to a laterally disposed bidirectional drive motor 21 by a drive belt 22. The drive motor 21 is attached to the side support 11 through a bracket 23 which includes a pair of horizontally extending flanges 24 which are clamped to rings 25 resiliently fixed to the ends of the drive motor 21.

As previously indicated, the bottom wall 13 includes a generally centrally located recess 14 having a flange 26 defining an opening 15 for receiving the combination sump and pump assembly 16. The main pump-sump housing 29 is generally annular and is assembled into the opening 15 in the bottom wall 13 from inside the washing chamber so that the upper flange 30 of the housing 29 engages the recessed flange 26 of the bottom wall 13. The flange 30 is connected to the bottom wall 13 recessed flange 26 with a plurality of threaded members and retainer clips. An annular seal 31 is disposed at the joint to prevent liquid leakage from the washing chamber.

A first portion of the housing 29 depending from the bottom wall 13 defines a generally annular sump 32 communicating with and facing generally upward toward the washing chamber as best shown in FIG. 1. Disposed generally below the sump 32 is a first recirculation pump cavity 33 defined by a second housing portion and having a volute form, as shown in FIG. 2, for receiving liquid from the sump 32 and through which the liquid is pumped to the liquid distribution system 34 for effecting washing of articles in the washing chamber.

Disposed below the volute recirculation pump cavity 33 is a radially smaller and generally annular drain pump cavity 35 for accommodating flow of liquids from the dishwasher sump 32 to an external drain. A more detailed description of the total pumping and recirculation system for this particular dishwasher construction is undertaken in U.S. Pat. No. 3,906,967 issued Sept. 23, 1975 to Richard P. Bergeson and assigned to the assignee of the instant invention.

Figure 3:
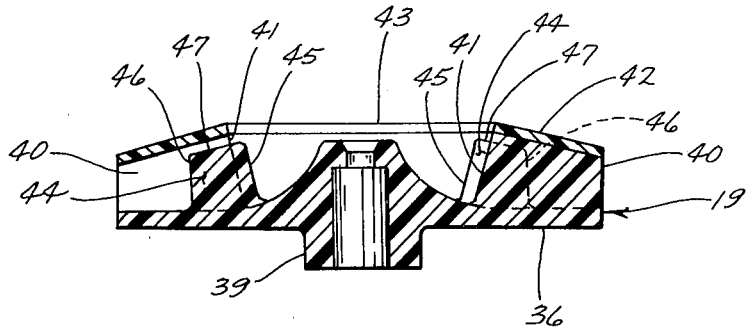
FIG. 3 is a sectional view of the recirculation pump impeller taken generally along lines 3—3 of FIG. 2.

As shown in FIGS. 1–3 the recirculation impeller 19 includes a generally disc-like base 36 having a hub 39 at the axis of rotation. Six primary vanes 40 are equally spaced about the axis of rotation and have a leading edge 41 radially spaced from the axis of rotation. Each of the primary vanes 40 extends along a substantially volute path to the outer periphery of the disc-like base 36. The six primary vanes 40 rise axially from the base 36 and terminate at and are fixed to a conical impeller cover 42 having a central opening defining a liquid inlet 43 to the impeller 19.

As best shown in FIGS. 2 and 3, the recirculation impeller 19 also includes six additional or secondary vanes 44 disposed centrally between the primary vanes 40 and having leading edges 45 spaced closer to the axis of rotation and trailing edges 46 spaced inwardly from the periphery of the base 36. As shown in FIG. 2, the secondary vanes 44 are of a substantially reduced cross-sectional thickness as compared to the primary vanes 40. Further, as best shown in FIG. 3, the secondary vanes 44 are axially shorter than the primary vanes 40 and do not join the underside of the impeller cover 42 but include an upper edge 47 generally parallel to but spaced from the cover 42 by one-sixteenth of an inch. The secondary vanes 44 extend outwardly toward the periphery of the impeller base 36 along a volute path which is four degrees askew from the path of the primary vanes 40.

As described relative to FIGS. 1 and 3, the impeller vanes 40 and 44 extend axially upwardly from the base 36 of the impeller 19. It is understood that the impeller 19 could be inverted or otherwise oriented and the vanes 40 and 44 would operate as described in the disclosed embodiments. The direction of axial extension from the impeller base 36 as used in describing the preferred embodiments in the specification and claims is derived from the orientation of the views as shown in FIGS. 1 and 3 while contemplating other operative orientations of the pump impeller 19.

Figure 4:
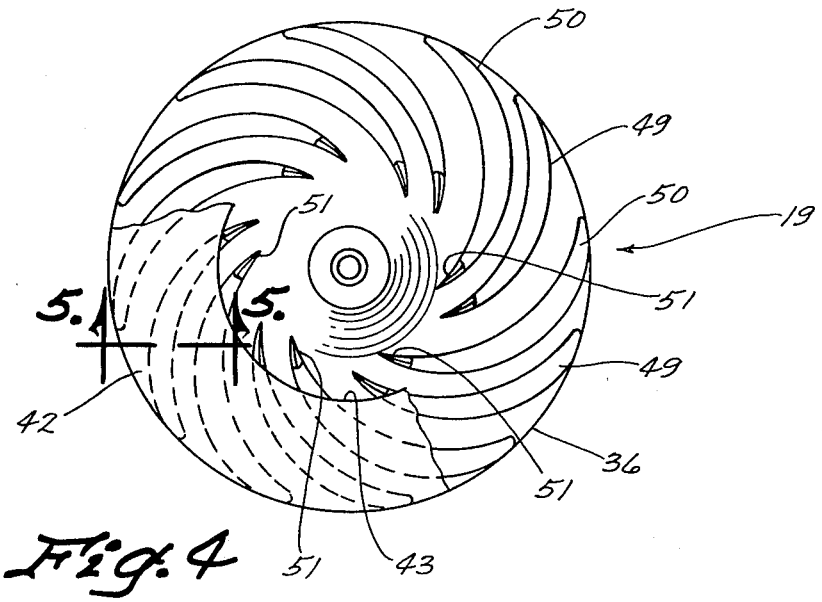
FIG. 4 is a view showing an alternate embodiment of the recirculation impeller.
Figure 5:
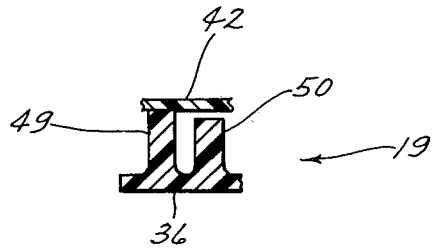
FIG. 5 is a view taken generally along lines 5—5 of FIG. 4 and showing the different axial lengths of the impeller vanes.

FIGS. 4 and 5, depict an alternate embodiment of the recirculation impeller 19 of the instant invention. The impeller 19 of FIG. 4 shows an impeller 19 having twelve primary and secondary vanes 49 and 50 of substantially equal thickness and length. In this alternate embodiment, the six secondary vanes 50 have leading edges 51 radially closer to the axis of rotation and, as shown in FIG. 5, are axially shorter than the primary vanes 49.

In a dishwashing apparatus as described herein the bidirectional drive motor 21 rotates the pump impellers 19 and 20 in a first clockwise direction, when viewed as in FIG. 2, for recirculation of washing liquid and in a second counterclockwise direction to initiate a draining of washing liquid from the dishwashing apparatus.

When operating in the counterclockwise drain direction the recirculation impeller 19 still has a tendency to pump liquid to the distribution system 34 even though it is being driven backwards. As shown in FIG. 2, the liquid will be pumped in the direction of the arrows 52 backwards through the volute form of the recirculation cavity 33 and past the cut-off shoulder 53 of the cavity 33 toward the pump outlet 54. When the sump 32 begins to empty of liquid, the liquid remaining in the recirculation cavity 33 will begin to mix with air and will swirl turbulently in the area of the pump outlet 54 as generally indicated by arrows 55. As the recirculation impeller 19 moves liquid past the cut-off shoulder 53 this turbulence from movement of combined air and liquid past the cut-off shoulder 53 results in pump noise during this portion of the drain cycle.

The recirculation impeller 19 of the preferred embodiment shown in FIGS. 1–3 and also in the alternate embodiment of FIGS. 4 and 5 both reduce the turbulent liquid flow conditions of the recirculation impeller 19 over a previous six vaned impeller and thus reduce the noise emitted from the pump. In both disclosed embodiments of the instant invention twelve smaller, closer spaced impulses or impacts of liquid, or liquid and air, are moved past the cut-off shoulder 53 of the volute during an increment of time. It is believed that these smaller, closer spaced liquid impacts tend to reduce the turbulence at the pump outlet 54 over the turbulence present when six full vanes are used. In both embodiments, the secondary vanes 44 and 50 have leading edges closer to the rotational axis than the primary vanes 40 and 49. Also, the secondary vanes 44 and 50 are axially shorter than the primary vanes 40 and 49. It is believed that this configuration incorporating the combination of inwardly spaced leading edges 41 and 51 and the reduced axial vane length deflects liquid away from the primary vanes 40 and 49 at the impeller inlet 43 and reduces the turbulent flow of liquid through the impeller 19 when rotated in the reverse direction.

In the preferred embodiment of the invention the secondary vanes 44 follow a volute path which is four degrees askew of the path followed by the primary vanes 40. The secondary vanes 44 are also thinner and have trailing edges 46 which terminate short of the outer periphery of the impeller base 36. The preferred embodiments of the instant invention significantly reduce the drain noise of the pump by reducing the turbulent flow conditions through the recirculation impeller 19 in the reverse or backward direction. The drain noise is also reduced by increasing the number of liquid or liquid and air impulses of reduced magnitude past the cut-off shoulder 53 of the volute.

It is contemplated that other vane configurations could be utilized to achieve the results of the preferred embodiments. For example, it is believed that either of the groups of vanes could be axially short and that either of the groups of vanes could be radially closer to the axis of rotation of the impeller 19. Further, it is anticipated that, possibly, one of the groups of vanes could depend from the impeller cover 42 leaving a gap between the depending vanes and the impeller base 36. The effective axial height could also be reduced by the vanes of one group being discontinuous at some point along their axial height.

The present invention thus provides an improved recirculation pump impeller 19 for a bidirectional pump having improved noise emission characteristics when driven in a reverse direction.

In the drawings and specification, there has been set forth a preferred embodiment of the invention and although specific terms are employed these are used in a generic and descriptive sense only and not for purposes of limitation. Changes in form and proportion of parts as well as the substitution of equivalents are contemplated as circumstances may suggest or render expedient without departing from the spirit or scope of the invention as further defined in the following claims.

I claim:

1. A centrifugal pump impeller rotatable in forward and reverse directions comprising: a base with a hub at the axis of rotation; a plurality of vanes fixed to said base and extending upwardly thereform, a first group of said vanes being spaced about said rotational axis with leading edges at a first radius spaced from said axis and with bodies extending outwardly toward the outer periphery of said base, a second group of said vanes being disposed between adjacent pairs of at least a portion of said first group of vanes with leading edges at a second radius closer to said rotational axis than the leading edges of said first group of vanes and with bodies extending outwardly and upwardly, said second group of vanes including vanes having at least a portion effectively reduced in axial height; and an impeller cover attached to at least a portion of one of said groups of vanes and axially spaced above the other group for defining a fluid passageway between the axial extremities of said other group of vanes and said impeller cover to reduce turbulent flow through said impeller when rotated in said reverse direction.

2. A centrifugal pump impeller as defined in claim 1 wherein said groups of vanes both extend along volute paths toward said periphery of said base with the vanes of one of said groups being askew from the vanes of the other group.

3. A centrifugal pump impeller rotatable in forward and reverse directions comprising: a base with a hub at the axis of rotation; a plurality of vanes fixed to said base and extending upwardly therefrom, a first group of said vanes being spaced about said rotational axis with leading edges radially spaced from said axis and with bodies extending outwardly toward the outer periphery of said base, a second group of said vanes being disposed between adjacent pairs of at least a portion of said first group of vanes with leading edges radially closer to said rotational axis and with bodies extending outwardly and upwardly, said second group of vanes being effectively axially shorter than said first group of vanes; and an impeller cover having a central opening defining an impeller inlet, said cover attached to said first group of vanes and spaced above said second group of vanes for defining a fluid passageway between the axial extremeties of said second group of vanes and said impeller cover for reducing turbulent flow through said impeller when rotated in the reverse direction.

4. A centrifugal pump impeller as defined in claim 3 wherein said second group of vanes includes vanes which are radially shorter than said first group of vanes.

5. A centrifugal pump impeller as defined in claim 3 wherein said plurality of vanes extend along volute paths toward said periphery of said base with said second group of vanes having volute paths different from the paths of said first group of vanes.

6. A centrifugal pump impeller rotatable in forward and reverse directions comprising: a base with a hub at the axis of rotation; an impeller cover axially spaced from said base and including a central opening defining an impeller inlet at said axis of rotation; a first plurality of vanes disposed between said base and cover and spaced about said rotational axis with leading edges radially spaced from said axis and with bodies extending generally axially between said base and cover and outwardly toward the outer periphery of said base, a second plurality of vanes interspersed with said first plurality of vanes and having leading edges radially closer to said rotational axis and also extending generally axially and outwardly, one of said first and second pluralities of vanes being effectively axially shorter than the other plurality of vanes for defining a space between the axial extremities of said shorter vanes and one of said base and cover for reducing turbulent flow through said impeller when rotated in the reverse direction, all of the vanes of said first and second pluralities being fixed to at least one of said base and cover, said impeller cover being attached to said base through at least some vanes of said first and second pluralities.

7. A centrifugal pump impeller as defined in claim 6 wherein said first and second pluralities of vanes extend along substantially volute paths toward the periphery of said base.

8. A centrifugal pump impeller as defined in claim 6 wherein both first and second pluralities of vanes are fixed to said base and extend axially upward therefrom.

9. A centrifugal pump impeller as defined in claim 8 wherein said second plurality of vanes are radially and axially shorter than said first plurality of vanes and have upper edges spaced from the underside of said impeller cover.

10. A centrifugal pump for a dishwashing apparatus operable in a first direction for recirculating washing liquid to a dishwashing chamber and in a second direction for draining washing liquid from dishwashing chamber, the combination comprising: a pump housing including recirculation and drain pump cavities with said recirculation cavity having a volute form including a cut-off shoulder forming the beginning of said volute; a drain impeller operably associated with said drain pump cavity for draining washing liquid from said dishwashing chamber when said pump is operated in said second direction; a recirculation impeller having a base with a hub at the axis of rotation and a plurality of vanes fixed to said base and extending axially upwardly therefrom, a first group of said vanes being spaced about said rotational axis with leading edges radially spaced from said axis and with bodies extending outwardly toward the outer periphery of said base, a second group of said plurality of vanes being disposed between adjacent pairs of at least a portion of said first group of vanes with leading edges radially closer to said rotational axis and also extending outwardly and upwardly; and an impeller cover attached to the upper portion of said first group of vanes, axially spaced above said second group of vanes and having a central opening defining an impeller inlet, said axial spacing defining a fluid passageway between the axial extremities of said second group of vanes and said cover for reducing turbulent flow through said impeller when rotated in said second direction.

11. A centrifugal pump as defined in claim 10 wherein said plurality of vanes extend along substantially volute paths toward the periphery of said base.

12. A centrifugal pump as defined in claim 10 wherein the upper edges of said vanes not attached to said impeller cover are generally parallel with the underside of said impeller cover.

13. A centrifugal pump as defined in claim 12 wherein said vanes not attached to said impeller cover are radially shorter than said attached vanes.

* * * * *